US005970629A

United States Patent [19]

Tucker et al.

[11] Patent Number: 5,970,629

[45] Date of Patent: Oct. 26, 1999

[54] FOOTWEAR AND COMPOSITE LINER FOR USE IN SUCH FOOTWEAR

[75] Inventors: Scott L. Tucker, Seattle; George Brown, Renton, both of Wash.

[73] Assignee: Montrail, Inc., Seattle, Wash.

[21] Appl. No.: 09/075,410

[22] Filed: May 8, 1998

[51] Int. Cl.[6] ..... A43B 23/07; A43C 11/00

[52] U.S. Cl. ..... 36/51; 36/55; 36/50.1

[58] Field of Search ..... 36/51, 55, 53, 36/50.1

*Primary Examiner*—Ted Kavanaugh
*Attorney, Agent, or Firm*—Ann W. Speckman; Janet Sleath

[57] ABSTRACT

An improved footwear closure system and composite liner are provided. The composite liner includes a first component that conforms closely to the upper in the area of the heel, toe and side portions of the upper, and a second, stretchable component that extends across and underneath the area between the split of the upper. The second, stretchable component may form an enlarged fold aligned generally with the centerline of the split of the upper. Both components of the composite liner are preferably constructed from a water-repellant or water-proof, breathable material. The composite liner cooperates with an improved closure system having two complementary strips mounted between the split of the upper and underlying the fasteners. When the closure system is drawn tight, any excess portion of stretchable component is collected between and outside the complementary strips, leaving a smooth surface on the inside of the upper in the area of the split and adjacent the instep.

14 Claims, 2 Drawing Sheets

FOOTWEAR AND COMPOSITE LINER FOR USE IN SUCH FOOTWEAR

TECHNICAL FIELD

The present invention relates to footwear, especially athletic and specialty outdoor footwear, having an improved structure and closure system in the area of the foot instep. The present invention relates, additionally, to a composite liner composed of materials, such as waterproof fabrics, having different stretch properties that, in combination with the improved closure system, provides greater footwear integrity and foot comfort.

BACKGROUND OF THE INVENTION

Footwear closure systems typically use a lacing or similar fastener system to fasten the shoe around the foot. In the simplest form of a lacing system, the upper is split down its middle bisecting the area above the instep, and eyelets or hooks or fasteners are located along either side of the split (eyestays). A lace is passed through the eyelets and criss-crossed across the split from the bottom of the split nearer the toe to the top of the split nearer the ankle. By pulling on the free ends of the lace, the split portions of the upper are drawn toward one another and the shoe is tightened around the foot. A tongue is generally provided underneath the split of the upper to provide a fully enclosed environment for the foot, and the eyestays pull together over the top of the tongue or any material lying between the eyestays. The tongue is frequently padded to protect the wearers' feet from the discomfort of the pressure of the laces.

Specialty outdoor and waterproof footwear construction typically incorporates a central tongue that lies underneath the laces when the closure system is drawn tight, with gussets connecting the sides of the tongue to each side of the upper in the area of the split. The gussets provide a continuous surface between the upper and the tongue, preventing liquids or debris from getting inside the shoe or boot. The gussets are also configured to provide an opening large enough to permit entry of the foot when the closure system is open. In this situation, the gusset is widest near the exposed end of the tongue nearest the ankle. When the closure system is tightened, the gusset material folds against the foot in the area on each side of the tongue generally next to or underneath the eyestays.

Waterproof footwear conventionally has a waterproof fabric liner provided in the interior of the footwear, contacting the foot. Waterproof and breathable fabrics are commonly provided in a simple construction involving a sock-like configuration shaped to fit within a shoe upper and attached to the top and bottom portions of the upper. The liner construction commonly follows the pattern of the boot or shoe upper in the region of the closure system, the liner having gussets matching the gussets in the area of the footwear closure to provide an opening for insertion of the foot. This construction allows the liner to form a continuous barrier to water from outside the shoe, thereby keeping the wearer's feet dry. The liner may have an integral, sock-like configuration with a lower portion generally following the configuration of the insole, or the liner may be attached to a separate component, such as a water impermeable plate or liner, that extends for the length of the interior of the footwear and is shaped to match the insole.

U.S. Pat. No. 4,599,810, for example, discloses an inner liner constructed of a material that is impervious to water but previous to perspiration vapors. The liner has a sock-like configuration, with fold portions similar to fold portions at the front of the shoe to allow the wearer to insert and remove his foot. The liner may be secured to the upper only in an area proximate the top opening.

When the closure system of this type is drawn tight, the gussets and liner between the eyestays fold or bunch as a result of the accumulation of material in the reduced distance between the eyestays. If the material is folded against the foot, the additional pressure caused by the accumulation of folded material under the tightened laces can be uncomfortable. Since the instep at the top of the foot is an especially sensitive part of the foot, where many blood vessels and tendons are near the surface, any points of pressure on the instep can cause discomfort. Additionally, since the upper must flex in the region of the instep to accommodate the hinge action of the ankle and foot, the potential to cause pain from the folded gusset and liner material is high.

In an effort to reduce the amount of folded material beneath the eyestays and next to the foot, some footwear designs limit the amount of excess fabric in the area of the instep. This compensation has the effect of reducing the size of the opening for insertion of the foot when the closure system is open. Outdoor footwear having a sock-like stretch booty constructed, for example, from Neoprene, is an example of this type of design. In this design, the stretch booty is attached to the inner surface of the-upper and underlies the closure system. In some designs, the stretch booty is not attached to the upper at the top of the footwear. When the closure system is drawn tight, there is little bunching of the stretch booty. Footwear having a stretch booty design is generally comfortable, but it can be difficult to insert and remove the foot, as a result of the relatively small opening for insertion of the foot. If the opening is large enough to comfortably accommodate insertion of the foot, the footwear is generally prone to having debris enter the interior of the boot at the top of the booty.

Waterproof footwear is highly desirable. U.S. Pat. No. 4,599,810 is one example of a water impervious liner. Another system for providing a waterproof environment inside footwear involves using a separate, waterproof sock or liner that is worn between the foot and the footwear. Such waterproof liners are versatile because a single pair may be used with a variety of footwear. Partially stretchable waterproof socks have been developed in an effort to reduce the amount of excess fabric and provide a sock that conforms closely to the foot. Nonetheless, the separate waterproof liners, even those made partially or wholly of stretchable fabric, still tend to bunch when the footwear closure system is drawn tight. A liner that is integral with the footwear generally provides a better fit, less excess fabric and greater comfort.

There thus remains a need in the art for footwear having a construction that permits easy entry and removal of a foot, and is comfortable in the area of the instep when the closure system is closed. Such footwear having a waterproof, breathable liner is especially desirable. The present invention is directed to footwear of this type.

SUMMARY OF THE INVENTION

The modified closure system of the present invention provides an opening suitable for easy entry and removal of the foot, and provides a smooth surface adjacent the foot and ankle when the closure system is drawn tight. A liner for use with the footwear is also provided. The liner has a composite construction, with the instep portion of the liner comprising a stretchable material, and the remainder of the liner following the general contour of the upper and comprising a material having non-stretching or reduced stretching capacity. The stretchable instep portion of the composite liner may form an enlarged fold that is generally aligned with the centerline of the split of the upper when the composite liner is mounted in footwear.

According to preferred embodiments, the composite liner is constructed from a first component comprising a high abrasion resistant, water resistant material provided adjacent and generally conforming to the configuration of the upper in the rear part of the footwear, along the sides, and underneath the foot. A stretchable, water resistant fabric forms the second component of the composite liner, in the area of the instep of the foot and in front of the ankle. The stretchable second component of the liner may conform generally to the configuration of the foot in the area of the instep, provided that the material comprising the second component is sufficiently stretchable to facilitate insertion of the foot into and removal of the foot from the footwear. Alternatively, the stretchable second component of the liner may form a fold that is enlarged in the area of the closure system between the split of the upper. The stretchable portion of the liner folds away from the foot between the two eyestays when the closure system is drawn tight, yet expands to allow the foot to be easily removed from the shoe when the closure system is open. The two liner components are preferably joined to form an integral, sock-like liner that is mounted on the interior of the upper, next to the foot.

According to especially preferred embodiments of the present invention, both components of the composite liner are constructed from high abrasion resistant, waterproof, breathable fabric, such as a GORE-TEX laminate. The second component of the composite liner preferably comprises a stretchable or elastic GORE-TEX laminate material, while the first component may comprise a non-stretch GORE-TEX laminate material, or a material having reduced stretching or elastic capacity. According to preferred embodiments wherein the liner is waterproof, the seams joining the two different liner portions are treated to provide a waterproof seal. They may, for example, be sealed with a waterproof seam tape, as is known in the art.

Stretchable, or elastic waterproof GORE-TEX laminates are preferred for the second component of the composite liner for two reasons. First, stretchable GORE-TEX laminate is generally more supple and pliable than other fabric laminates available for footwear, making any wrinkles in the fabric that may form upon fastening of the closure system more comfortable for the foot. Second, stretchable GORE-TEX laminates easily stretch when the closure system is open for convenient insertion and removal of the foot from the footwear. This design allows the use of less material, which is desirable because it reduces the cost and weight of the footwear.

The composite liner is preferably used in combination with an improved footwear closure system having two complementary strips of material running along and between the eyestays. The lateral portion of each strip may be attached to an eyestay, for example, along the lateral edge of the strip and beneath or adjacent the edge of the eyestay. The strips extend toward the centerline of the shoe upper and cover at least a portion of the space between the eyestays. When the closure system is open, a fold of the stretchable second component of the composite liner may extend between the two strips, facilitating insertion and withdrawal of the foot.

When the closure system is drawn tight, the medial portions of the two strips are pulled close to one another and substantially fill the gap between the eyestays. With the closure system fastened tight across the instep, the strips effectively cushion the foot from the laces or fasteners. Any excess composite liner material in the area of the instep collects between and/or above the medial portions of the strips. According to preferred embodiments, when the closure system is drawn tight, any excess portion of the composite liner forms a fold between the two strips. The fold effectively moves the excess liner material away from contact with the foot, leaving only a smooth surface next to the foot beneath the closure system. Less pressure is exerted against the foot, resulting in greater comfort and function.

DETAILED DESCRIPTION OF THE PREFERRED EMBODIMENTS

Figure 1:
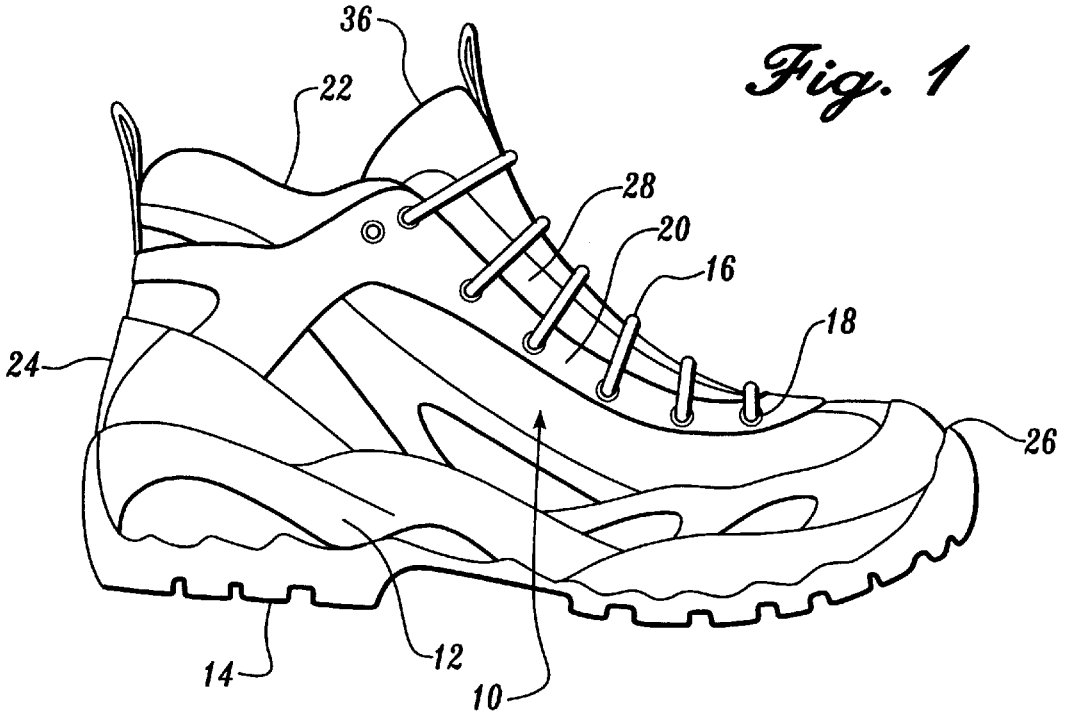
FIG. 1 is a persective view of a shoe having a conventional upper and sole construction, with a composite liner and improved closure system of the present invention.

FIG. 1 shows footwear comprising an upper, indicated generally as 10, a midsole 12, an outsole 14, and an insole (not shown) on the interior lower surface of the footwear. The shoe illustrated in FIG. 1 has a conventional shoe lace 16 engaged in eyelets 18. Upper 10 is partially split at the central, top portion of the footwear. Eyestays 20 are provided at the edge of the split and eyelets 18 are in proximity to the split. Collar 22 is provided to support the foot and/or ankle. The heel region is indicated at 24 and the toe region at 26. These elements of the footwear illustrated in FIG. 1 are generally conventional.

Figure 2:
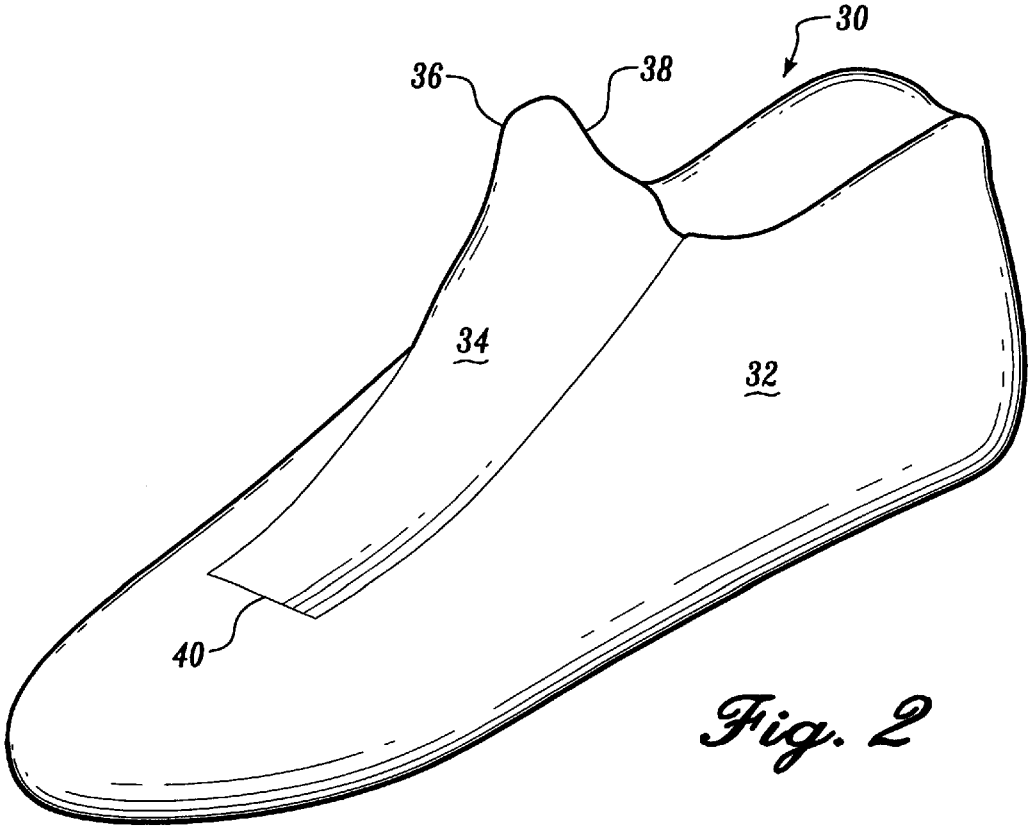
FIG. 2 is an enlarged schematic, perspective view of a composite liner having an enlarged fold in the area of the instep for use in combination with the improved closure system of the present invention.

A fabric liner is generally provided contacting the interior surface of upper 10 so that the foot does not directly contact the interior surface of upper 10. A preferred composite liner 30 of the present invention is illustrated in FIG. 2. Composite liner 30 comprises first component 32 that generally conforms to the configuration of the interior surface of upper 10 in the heel and toe, and along the sides of the upper, and conforms to the configuration of the insole underneath the foot. First component 32 generally has one or more seams to provide the desired three-dimensional configuration conforming to upper and insole, which are preferably sealed using techniques known in the art to maintain the waterproof character of the liner. The seams may be located and provided as is knows in the art. First component 32 preferably comprises an abrasion resistant, flexible fabric, and most preferably comprises a fabric that is water resistant or waterproof, and that is breathable, such as a GORE-TEX laminate material. A 3-bar knit GORE-TEX laminate is especially preferred for first component 32.

Second component 34 of composite liner 30 is provided in the area of the instep and, when the liner is installed in footwear, extends between eyestays 20 underneath lace 16. Second component 34 is preferably sized so that when it is mounted in footwear, the totality of liner 30 that is exposed between the split of upper 10 comprises second component 34. Second component 34 preferably comprises an abrasion resistant, stretchable material, and most preferably comprises a fabric that is stretchable and water resistant or waterproof, and that is breathable. Stretchable GORE-TEX laminate materials are preferred. First and second components 32 and 34, respectively, are joined to form composite liner 30. According to preferred embodiments, the seams between first and second components 32 and 34 are sealed using techniques that are known in the art to maintain the waterproof character of the liner.

Figure 3:
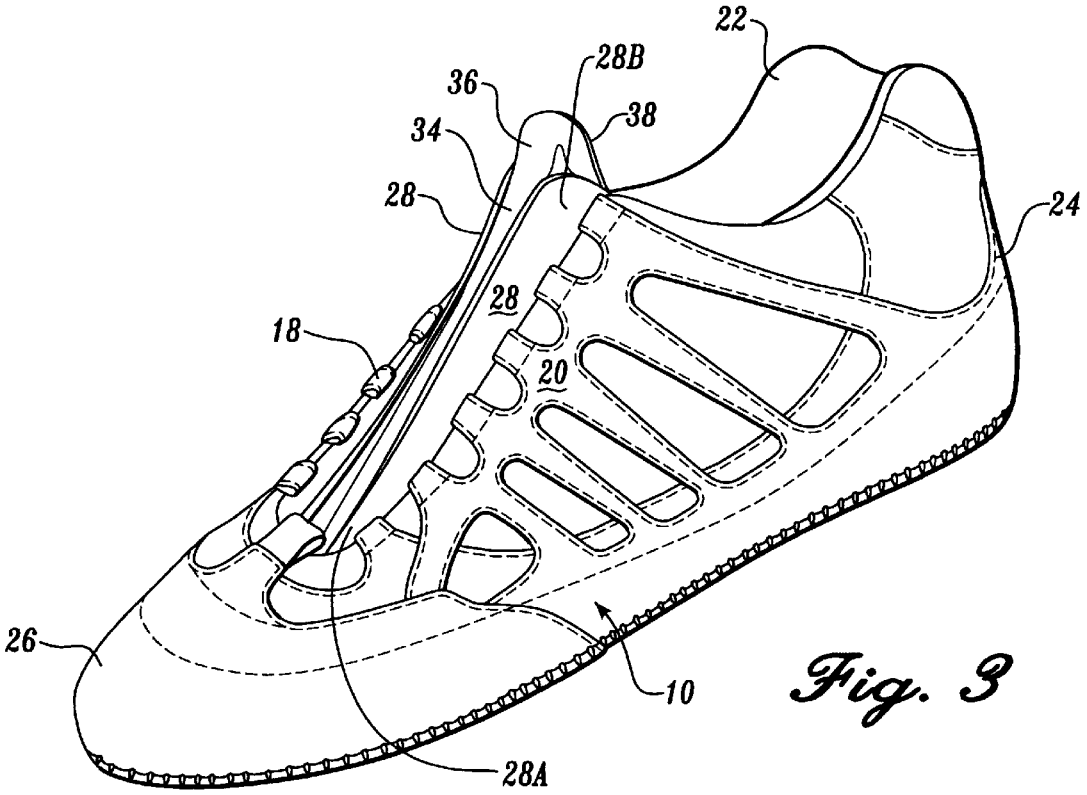
FIG. 3 is a perspective view of an upper having a composite liner in combination with the improved closure system of the present invention prior to attachment of the midsole and outsole.

Second component 34 may conform to the configuration of the foot instep, provided that the material comprising second component 34 has sufficient stretchiness or elasticity to facilitate insertion of a foot into and removal of a foot from footwear having such a composite liner. Alternatively, enlarged fold 36 is provided in an upper central portion of second component 34 of composite liner 30 and, when the liner is installed in footwear, enlarged fold 36 extends between the split of upper 10, as illustrated in FIGS. 1 and 3. Enlarged fold 36 is especially pronounced at edge 38, where its stretchable character facilitates easy entry of a foot into and removal of a foot from the footwear and liner. According to a preferred embodiment, second component 34 preferably has a tapered configuration, in which enlarged fold 36 at edge 38 is the widest portion of second component 34, and interface edge 40 is the narrowest portion of second component 34. According to preferred embodiments, edge 38 of second component is at least 50% wider, and preferably at least 100% wider than interface edge 40.

The precise dimensions of second component 34 as well as composite liner 30 will, of course, depend on the design of the footwear and, in particular, the cut of the footwear in the area of the opening. A composite liner for "low-cut" footwear will be generally as shown in FIG. 2, while a liner for footwear having a higher cut will be lengthened in the area of the ankle. Such adjustments may easily be made by one of ordinary skill in the art. At interface edge 40, composite liner 30 preferably conforms closely to the interior of upper 10. Although second component 34 is illustrated as a tapered panel, it will be recognized that the precise boundaries between first component 32 and second component 34 may be varied to suit different footwear styles and needs.

Composite liner 30 is attached to the interior of upper 10, such as with stitching at the collar 22, and with glue at other points around the interior of the upper, such as at toe 26, heel 24, and under the insole. These attachment points serve to position and secure composite liner 30 within upper 10. The desired attachment points may vary depending upon the design and function of the footwear.

Unlike the conventional waterproof liner construction, the design of composite liner 30 may conform to the configuration of the upper only in part. The liner may diverge from the conformation of the upper in the region between the split of upper 10 at the instep. In particular, according to one embodiment, the stretchable second component 34 of composite liner 30 is made using an excess of material such that the liner in the area of enlarged fold 36 fits loosely on-he foot when the closure system is open. This allows the foot to be easily inserted and removed from the shoe.

Enlarged fold 36 of composite liner 30 cooperates with an improved closure system of footwear of the present invention. As illustrated in FIGS. 1 and 3, complementary strips 28 are mounted on either side of upper 10 between the split of the upper. Strips 28 are preferably mounted to upper 10 underneath and/or adjacent eyestays 20 and extend toward the centerline of the split of upper 10, and toward the centerline of second component 34 of composite liner 30. Strips 28 are mounted with their exposed surface contacting the footwear fasteners, such as laces 16, and their underneath surfaces contacting second component 34 of composite liner 30. Strips 28 are preferable tapered, so that toe portion 28A is narrower than instep portion 28B. The width of strips 28 is adjusted so that the medial edges of complementary strips 28 approach one another and may contact, but don't overlap, when the footwear closure system is closed. Lacing 16 overlies strips 28, which may be padded to protect the instep from the pressure of lacing 16 when the closure system is closed. The exposed surfaces of strips 28 are preferably constructed from an abrasion-resistant, water-repellant material.

Figure 4:
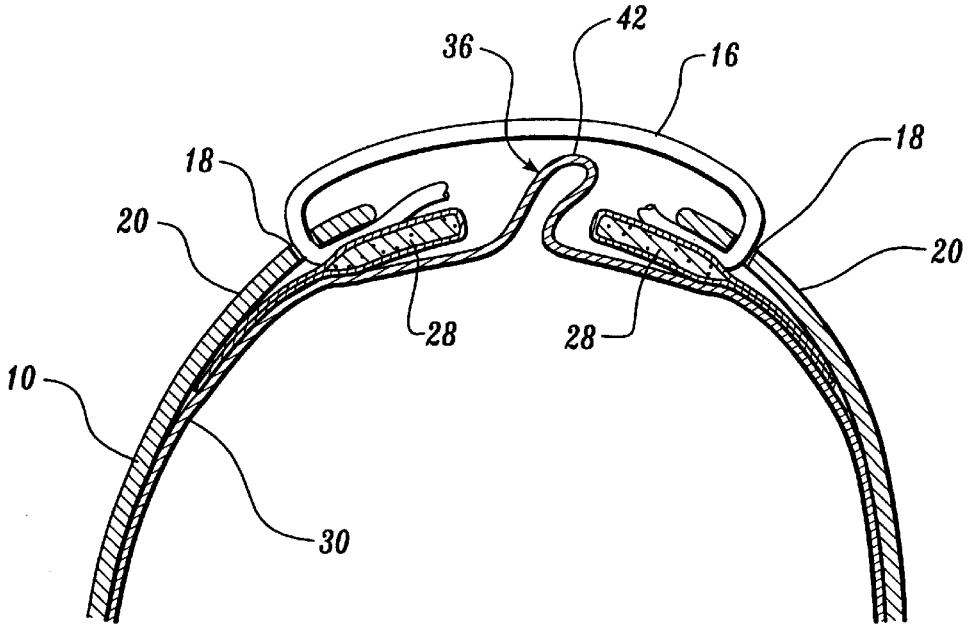
FIG. 4 an enlarged, partially cross-sectional view of footwear of the present invention incorporating a composite liner having an enlarged fold and an improved closure system in the area of the instep when the closure system is drawn tight.

FIG. 4 illustrates the footwear closure system of the present invention in a closed condition. When the closure system is drawn tight around the foot, enlarged fold 36 of second component 34 of composite liner 30 is collected between and "outside" strips 28 and is folded away from the foot in a single fold 42. Thus, when the closure system of the present invention is drawn tight, a smooth surface is provided on the inside of the upper in the area of the split. This system provides greater comfort and reduces the pressure on the instep, while also providing easy and convenient access to the footwear.

The footwear closure system and composite liner of the present invention are described with respect to certain preferred embodiments. It will be recognized, however, that additional configurations, arrangements and embodiments may be used without departing from the present invention.

We claim:

1. An article of footwear having an improved closure system in which a liner and an upper are integrated to form the closure system, the article of footwear comprising:

an upper having a heel portion, a toe portion, side portions, a central split in the area of a footwear closure system, and two cushioning strips, each of the cushioning strips mounted in proximity to an opposite side of the split of the upper and extending toward a centerline of the split of the upper, the two cushioning strips being mounted symmetrically with respect to a centerline of the split; and a liner adjacent an interior surface of the upper, the liner conforming to the interior surface of the upper in the area of the heel portion, the toe portion, and the side portions, and comprising a stretchable material forming an enlarged fold extending between the split of the upper whereby, when the closure system is drawn tight, the enlarged fold of the liner is disposed between the cushioning strips.

2. An article of footwear according to claim 1, wherein the complementary cushioning strips are tapered, with a strip portion nearer the toe portion of the upper being narrower than a strip portion nearer a foot insertion opening of the footwear.

3. An article of footwear according to claim 1, wherein the liner is a composite liner composed of two different materials.

4. An article of footwear according to claim 3, wherein the composite liner is composed of a first stretchable fabric and a second fabric having lower stretch characteristics than the first stretchable fabric.

5. An article of footwear according to claim 4, wherein a portion of the liner conforming to the interior surface of the upper in the area of the heel portion, the toe portion, and the side portions are composed of the second fabric, and a portion of the liner extending between the split of the upper is composed of the first, stretchable fabric.

6. An article of footwear according to claim 1, wherein the liner is composed of one or more materials having water-resistant qualities.

7. An article of footwear according to claim 1, wherein the liner is composed of one or more materials having water-resistant and breathable qualities.

8. An article of footwear according to claim 1, additionally comprising an outsole and an insole.

9. An article of footwear according to claim 8, additionally comprising a midsole mounted between the outsole and the insole.

10. An article of footwear according to claim 1, wherein the portion of the liner comprising a stretchable material and extending between the split of the upper conforms generally to the configuration of a foot instep.

11. An article of footwear according to claim 1, wherein the liner is a composite liner composed of two different materials, with the enlarged fold extending between the split of the upper being composed of a first stretchable fabric and the portions of the liner conforming to the interior surface of the upper in the area of the heel portion, the toe portion, and the side portions being composed of a second fabric having lower stretch characteristics than the first stretchable fabric.

12. An article of footwear according to claim 1, wherein the liner comprises a first component, composed of a first material that conforms to the interior surface of the footwear upper in the area of the heel portion, the toe portion and side portions, and a second component, composed of a second material that forms an enlarged fold in the area between the split of the upper, the first and second components being joined to one another to form an integral, sock-like liner.

13. An article of footwear according to claim 12, wherein the second material has higher stretching qualities than the first material.

14. An article of footwear according to claim 13, wherein both the first and second materials comprise water-resistant materials.

* * * * *

UNITED STATES PATENT AND TRADEMARK OFFICE

CERTIFICATE OF CORRECTION

PATENT NO : 5,970,629

DATED : October 26, 1999

INVENTOR(S) : Scott L. Tucker and George Brown

It is certified that error appears in the above-identified patent and that said Letters Patent are hereby corrected as shown below:

| Col. No. | Line(s) | Edits |
|---|---|---|
| 1 | 66 | Replace "previous" with --pervious-- |
| 2 | 26 | Replace "the-upper" with --the upper-- |
| 5 | 63 | Replace "loosely on-he" with --loosely on the-- |

Signed and Sealed this

Tenth Day of April, 2001

Nicholas P. Godici

*Attest:*

NICHOLAS P. GODICI

*Attesting Officer*

*Acting Director of the United States Patent and Trademark Office*